US005301589A

United States Patent [19]

Spadafora et al.

[11] Patent Number: 5,301,589

[45] Date of Patent: Apr. 12, 1994

[54] VIOLIN BOW GUIDE

[75] Inventors: Robert J. Spadafora, 506 Annette Street, Toronto, Ontario, Canada, M6P 1S3; Philipp Kraemer, 34 Kendleton Drive, Rexdale, Ontario, Canada, M9V 1V4; Malcolm B. Stephens, Waterloo, Canada

[73] Assignees: Robert J. Spadafora; Philipp Kraemer, Ontario, Canada

[21] Appl. No.: 838,728

[22] PCT Filed: Sep. 27, 1990

[86] PCT No.: PCT/CA90/00321

§ 371 Date: Mar. 10, 1992

§ 102(e) Date: Mar. 10, 1992

[87] PCT Pub. No.: WO91/05328

PCT Pub. Date: Apr. 18, 1991

[30] Foreign Application Priority Data

Sep. 28, 1989 [CA] Canada ..... 614356

[51] Int. Cl.[5] ..... G10G 7/00

[52] U.S. Cl. ..... 84/283

[58] Field of Search ..... 84/283

[56] References Cited

U.S. PATENT DOCUMENTS 2,239,579 4/1941 Solodar ..... 84/283

4,554,859 11/1985 Hanly ..... 84/283

*Primary Examiner*—M. L. Gellner

*Assistant Examiner*—Cassandra Spyrou

*Attorney, Agent, or Firm*—Merchant, Gould, Smith, Edell, Welter & Schmidt

[57] ABSTRACT

A violin bow guide has a rod (38) which is attached to the back of a bow (58). The rod (38) travels through a rod guide (36) which is held in place over the strings of the violin on a support (11) which attaches to the body of the violin. The rod guide (36) is pivotally mounted to permit the bow (58) to play on all the strings. Means are provided for adjusting the height of the rod above the strings, the position of the bow between the bridge and fingerboard of the violin, and the amount of resistance to movement of the rod through the rod guide. The rod guide (36) can be locked at a selected height above the strings or permitted to float freely up and down.

14 Claims, 6 Drawing Sheets

VIOLIN BOW GUIDE

TECHNICAL FIELD

This invention is a bow guide to aid players of bowed instruments in the violin family, such as the violin, to learn the art of bowing. Violin students and players normally have much difficulty learning to hold a straight line with the bow, i.e. to avoid moving the hand in an arc toward the bridge when bowing. The present invention helps the player to bow in a straight line, and to produce even sound from the violin.

BACKGROUND ART

Various devices are known which are intended to assist the student in learning bowing technique. Such devices are shown in U.S. Pat. Nos. 2,041,146, issued May 19, 1936 (Portnoff); 2,239,579, issued Apr. 22, 1941 (Solodar); 2,240,696, issued May 6, 1941 (Gusman); 3,169,438, issued Feb. 16, 1965 (Belcher); 3,188,901, issued Jun. 15, 1965 (Baderak); 2,782,670, issued Feb. 26, 1957 (Lipski); 3,306,150, issued Feb. 28, 1967 (Philips); 3,987,700, issued Oct. 26, 1976 (Dunlap); 4,222,302, issued Sept. 16, 1980 (Sanfilippo); and 4,554,859, issued Nov. 26, 1985 (Hanley).

SUMMARY OF THE INVENTION

The present invention provides a bow guide for a stringed, bow-played instrument, such as a violin, comprising a rod, means for attaching the rod to the bow whereby the rod extends substantially between the ends of the bow, a rod guide having means for slidably receiving the rod and for guiding the rod for movement at substantially right angles to the strings, and means for supporting the rod guide above the strings and between the bridge and fingerboard thereof, whereby the bow may slidably engage the strings at substantially right angles thereto.

In a preferred embodiment, the present invention provides a violin bow guide comprising a rod, means for attaching the rod to the bow generally parallel to the back of the bow, a rod guide having means for slidably receiving the rod, and rod guide support means for supporting the rod guide above the strings of the instrument and between the bridge and fingerboard thereof, the rod guide support means having an axis about which the rod guide is pivotally attached, the axis being generally parallel to the strings and perpendicular to the means for slidably receiving the rod, whereby the bow may slidably engage the strings of the instrument.

The present invention enables the player to practice bowing in a straight line while playing on a real violin with a real bow (unlike in some of the prior art devices) and therefore hear the effect of the movement of the bow into and across the strings. The device permits the bow to play on all strings, separately or in groups. It can lock the bow on single strings or on groups of strings. It can be set to allow the player to control the depth of the bow on the strings, or, if preferred, the depth of the bow on the strings can be fixed. It can be set to hold selected positions of the bow between the fingerboard and the bridge of the violin. It can lock the angle of the bow relative to the strings, or permit the player to freely vary this angle. It can be set to have resistance to the back and forth movement of the bow so that the player will have a force to pull and push against when learning finger and wrist movement on the bow.

BEST MODE FOR CARRYING OUT THE INVENTION

Figure 1:
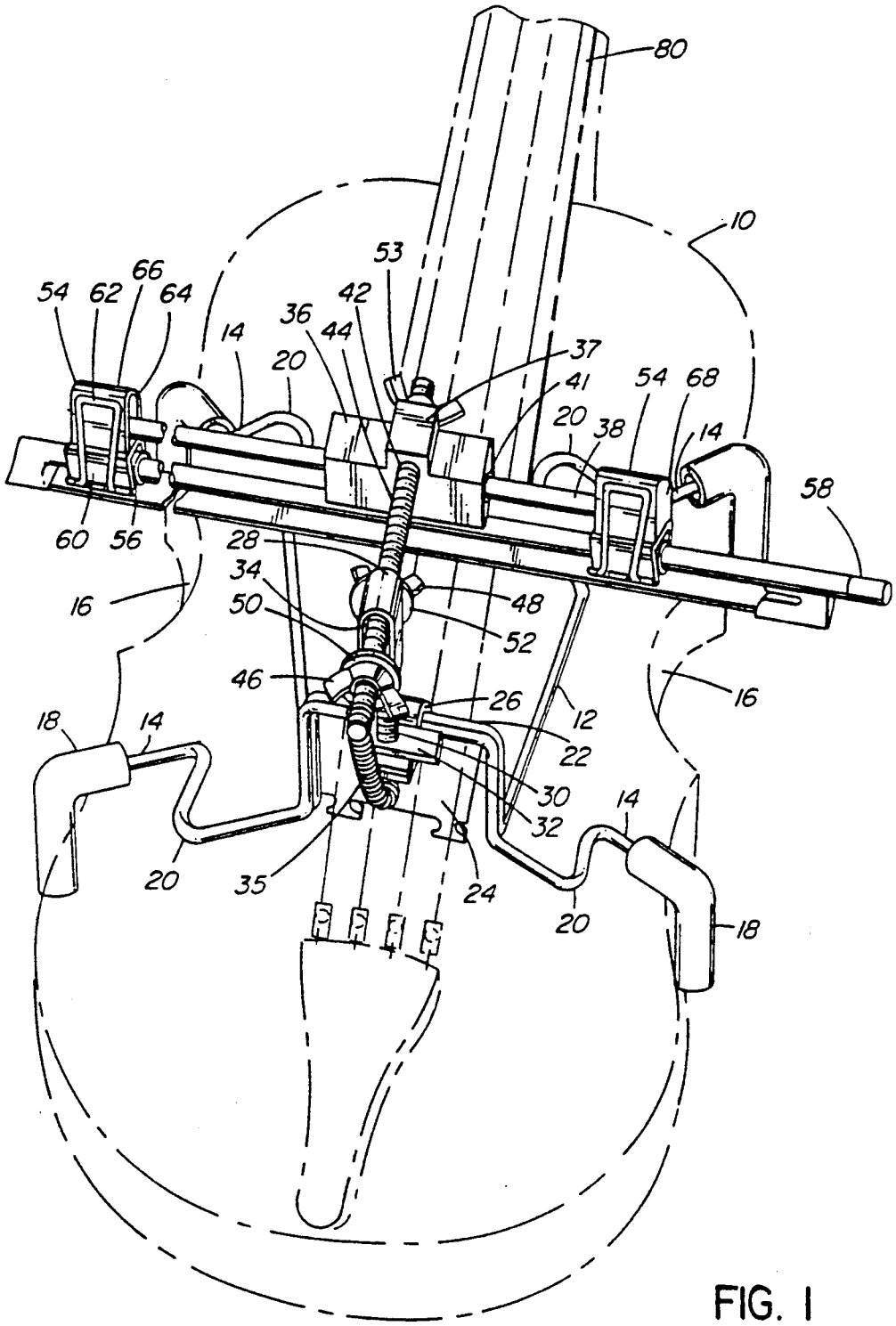
FIG. 1 is a perspective view of a first embodiment of the bow guide according to the invention, mounted on a violin.

Referring to FIG. 1, which illustrates a first preferred embodiment of the bow guide affixed in operative position on a violin 10, the bow guide has stand 12 formed of flexible wire rod. Stand 12 has four end portions 14 which grip the body of violin 10 at the outside corners of the C-slots 16. Protective rubber covers 18 cover end portions 14 to protect the violin. Stand 12 has four leg portions 20 with bends therein to provide flexibility and contribute to the grip of the stand on the violin. Stand 12 has bridge section 22 which extends horizontally across the violin above the bridge 24.

Mounting clip 26, which has a threaded bore 42 therethrough, is mounted on bridge section 22. It can be slid from side to side across bridge section 22 and can be locked into a selected position thereon. Slotted slide 28 is mounted on mounting clip 26. Slotted slide 28 has bolt portion 30 which engages the threaded bore of mounting clip 26. Lock arm 32 is threaded on bolt portion 30 immediately above mounting clip 26, and can be tightened down onto mounting clip 26 to affix it firmly in place on bridge section 22.

The slotted slide 28 is a narrow sleeve which is closed at its upper end. Its lower ends are affixed, for example by spot welding, to bolt portion 30. It provides a relatively narrow and long slot 34 between the sides of the slotted slide, which extends upward from bolt portion 30.

Figure 3:
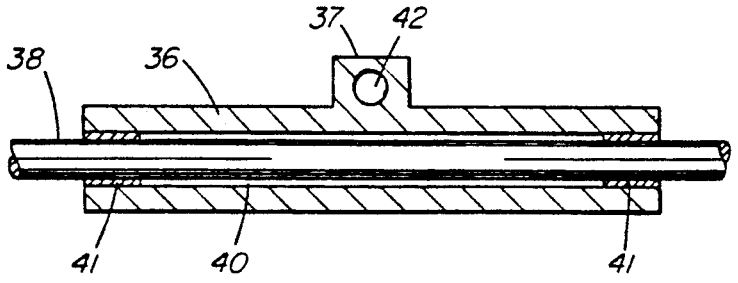
FIG. 3 is a cross-sectional view through the rod guide.

Rod guide 36 is a hexahedral metal block with a raised portion 37 on the upper middle part thereof. As shown in FIG. 3, rod guide 36 has a circular bore 40 through the long axis thereof for receiving rod 38. Two bearings 41 are inserted in the ends of bore 40, one in either end. Rod 38 can move slidably through these bearings. Threaded bore 42 extends through raised portion 37 at right angles to bore 40. Threaded bolt 44 is threaded through bore 42 and extends therefrom. The other end of bolt 44 extends through slotted slide 28 and is held therein by wing nuts 46, 48 and washers 50, 52. Wing nut 53 is threaded on the end of bolt 44 which extends through rod guide 36, and can be tightened against rod guide 36 if desired to keep rod guide 36 from rotating about threaded bolt 44. When wing nut 53 is not tightened, rod guide 36 can pivot freely about bolt 44. The height of bolt 44 above the strings can be set by moving it up or down in slot 34 and tightening wing nuts 46, 48 when it is at the selected position.

Bolt 44 is ground flat on two opposite sides thereof. The width between the flat sides provides for a snug but slidable fit in slotted slide 28, slot 34 being only slightly wider than the width of bolt 44 across its flat sides. Bolt 44 is higher than it is wide, by reason of the threads at the top and bottom sides, preventing it from rotating in slot 34 even if wing nuts 46 and 48 were not sufficient to prevent its rotation.

Coil spring 35 extends between the lower end of bolt 30 and the end of bolt 44 which extends toward the chinrest of the violin. It urges the end of bolt 44 to which it is attached downward. Accordingly, if wing nuts 46, 48 are loosened, the opposite end of bolt 44, and the attached rod guide 36, rod 38 and bow 58 are urged upwards, as bolt 44 pivots about its point of contact with the top of bolt 30. The extent to which bolt 44 can pivot is controlled by the extent to which wing nuts 46, 48 are loosened. When wing nuts 46, 48 are tightened securely bolt 44 does not pivot and is held in a fixed position substantially parallel to the strings of the violin. When they are loosened, the bow is suspended above the strings by virtue of the action of spring 35, and requires a downward pressure by the violinist to contact the strings. The amount of pressure required depends on the strength of spring 35, and is preferably slight. Also, the distance between rod guide 36 and slotted slide 28 will affect the strength of spring 35 required; where rod guide 36 (and therefore bow 58) is moved toward the fingerboard, a stronger spring is required. A spring having a suitable strength must be selected to suspend the rod guide, rod and bow when bolt 44 is allowed to pivot, while at the same time not requiring undue force by the player to bring the bow down into contact with the strings.

Two sleeves 54 are firmly affixed to the back of bow 58, one proximate the tip and one proximate the heel thereof. Sleeves 54 have clip portions 60, made of spring steel, which grip bow 58. Soft rubber pads 56 are wrapped around the bow for protection where it is gripped by clip portions 60. Clip release arms 62 are provided on clip portions 60. When squeezed together, the clip release arms 62 open clip portion 60 and permit removal of sleeves 54 from bow 58. The upper part of sleeve 54 is a hood-like structure, open at the inside end to permit entry of rod 38, but otherwise closed by the sides 64, back 68 and top 66. The sides 64 are spaced apart somewhat wider than the outside diameter of rod 38 to permit the free up and down movement of each end of rod 38 within its corresponding sleeve 54.

Sleeves 54 are positioned on bow 58 at a distance apart whereby the ends of rod 38 are close to backs 68 of the sleeves.

Figure 4:
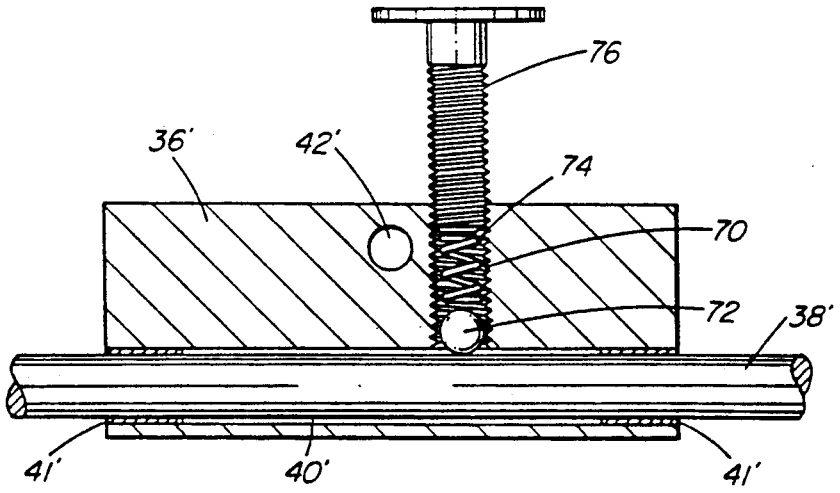
FIG. 4 is a cross-sectional view through an alternative embodiment of the rod guide.

In the alternative embodiment of the rod guide, shown in FIG. 4, there is provided in the upper surface of rod guide 36' a threaded bore 70. Bore 70 intersects bore 40' and contains ball 72 which is urged against rod 38' by coil spring 74, which is positioned in bore 70 atop ball 72. The downward pressure on ball 72 can be increased or decreased by tightening or loosening bolt 76 in bore 70.

Figure 2:
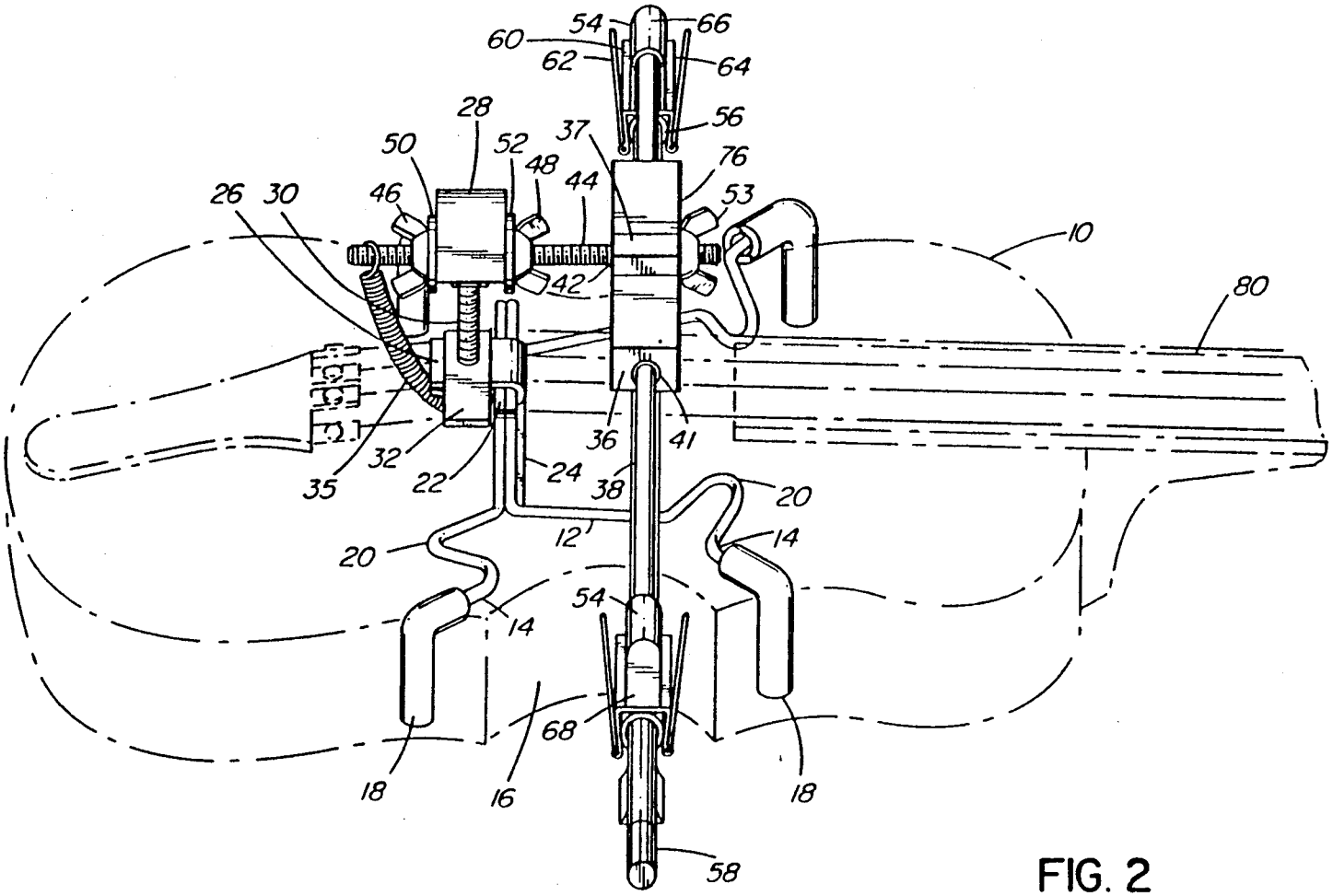
FIG. 2 is another perspective view of the embodiment shown in FIG. 1, viewed from the side of the violin.

In a preferred mode of operation, the bow guide is installed on a violin in the manner depicted in FIGS. 1 and 2. Bolt 44 is set at a suitable distance above the strings so that the hair of the bow can engage the strings with the desired degree of pressure. This distance can also be adjusted by varying the height of bolt 30 in mounting clip 26. Bolt 44 is set parallel to the strings and locked in this position by tightening look arm 32. Wing nuts 46, 48 are tightened on threaded bolt 44 to secure it in place.

If the rod guide shown in FIG. 4 is employed, bolt 76 can be loosened so that ball 72 is not urged against rod 38' by spring 74, and substantially all of the resistance encountered by rod 38' is the frictional resistance between rod 38' and bearings 41'. Alternatively, bolt 76 can be tightened to produce more resistance, if required.

When the bow guide is set up in this manner, the student can move the bow across the strings of the violin, while the bow guide ensures that the bow is maintained in a position at substantially right angles to the strings. By virtue of the freedom of the bow to move up and down within sleeves 54, the hair of the bow can contact all the strings, including the outer ones, with a suitable degree of pressure and control, as the various strings are played in the course of an exercise.

Depending upon the exercises to be performed, the bow may be set to play only on a single string or pair of strings, by tightening lock nut 53 against rod guide 36 when rod guide 36 is in a selected position, thus preventing rod guide 36 from pivoting.

Likewise, it is possible to loosen lock arm 32 so threaded bolt 44 is not held in a fixed position. With this adjustment, however, the bow is not fixed for movement at right angles to the strings.

The position of rod guide 36, and therefore of bow 58, between the bridge 24 and fingerboard 80 can be selected by extending bolt 44 a chosen distance through slot 34. Wing nuts 46, 48 and their accompanying washers 50, 52 are then positioned to bracket the slotted slide 28 and hold bolt 44 in the selected position.

In another preferred mode of operation, wing nuts 46, 48 are loosened so bolt 44 is not held rigidly in slotted slide 28, but is allowed to pivot a selected distance, suspending bow 58 above the strings. This affords the player greater control over the up and down movement of the bow relative to the strings than when bolt 44 is fixed. The player is thus able to practice "off the string" bowing techniques.

Numerous mechanical variations from the form of bow guide described above are possible, and are included within the scope of the invention.

For example, stand 12 can be made in a variety of sizes to fit different sized instruments. It can be provided with clamps as an alternate means of affixing it to the violin body, if desired.

There are also various alternate ways of mounting the slotted slide on the mounting clips. For example, the slotted slide can be constructed with a knurled fitting that would fit into a mating fitting on the mounting clip; this would maintain the slotted slide at a selected angle relative to the strings.

If it is desired to restrict the length of bow strokes, or restrict the player to a particular part of the bow, two clips can be attached to rod 38, one on either side of rod guide 36, at a selected distance apart.

Rod 38 need not be round in cross-section. One possible variation is to have a rod that is multisides in cross-section, with correspondingly-sgaoed bearings in the rod guide. Indentations could be provided in the various side of such rods, at equal spacing on each side, but with different spacings between sides, that could engage ball 72, for use in learning staccato playing.

Various different means can be provided for pivoting bolt 44 and the rod guide upward. For example, a coil spring could extend between an arm extending upwardly from slotted slide 28 and the end of bolt 44 adjacent the rod guide. Several mechanically equivalent configurations can be readily devised.

Figure 5:
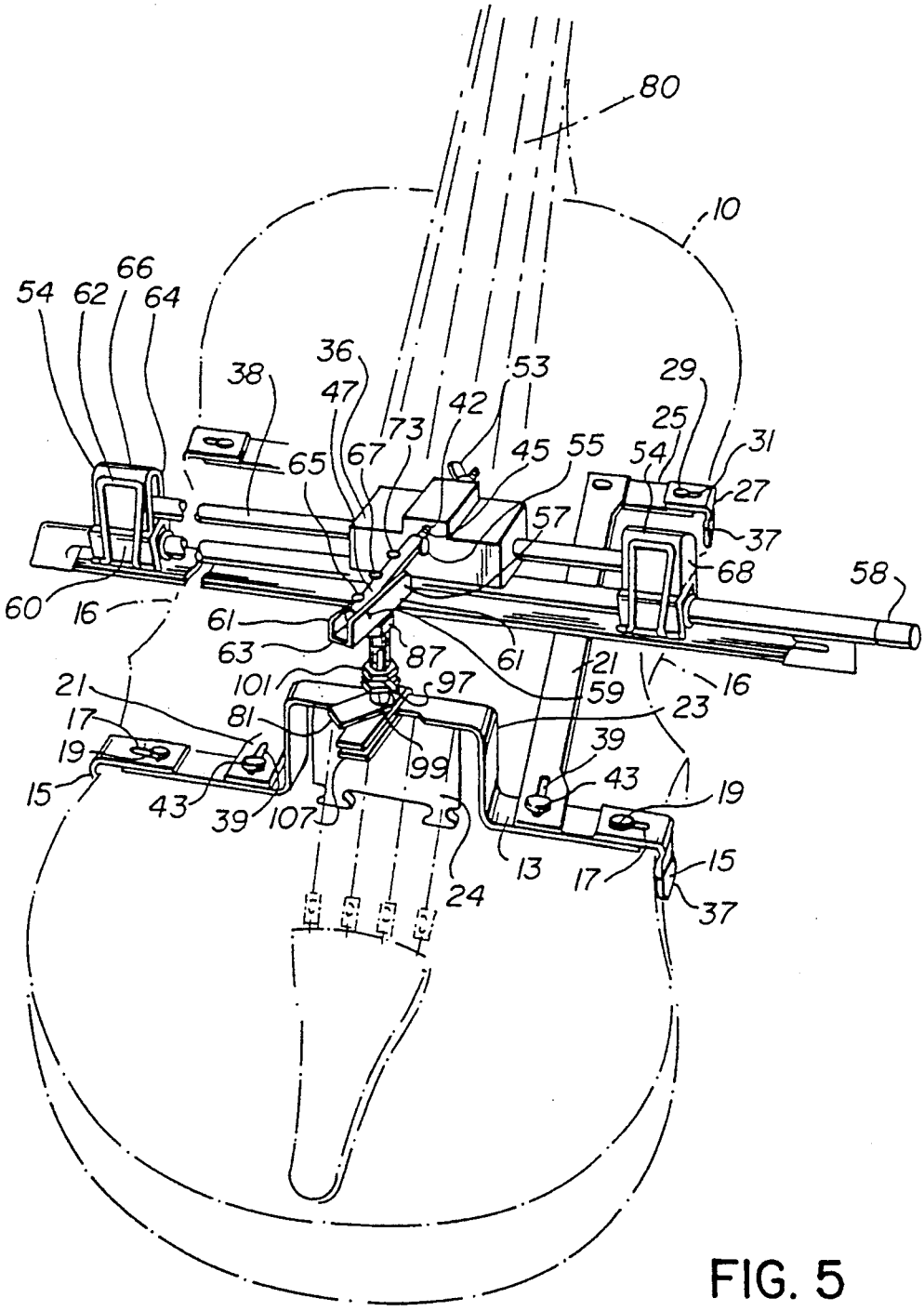
FIG. 5 is a perspective view of a second embodiment of the bow guide, mounted on a violin.
Figure 6:
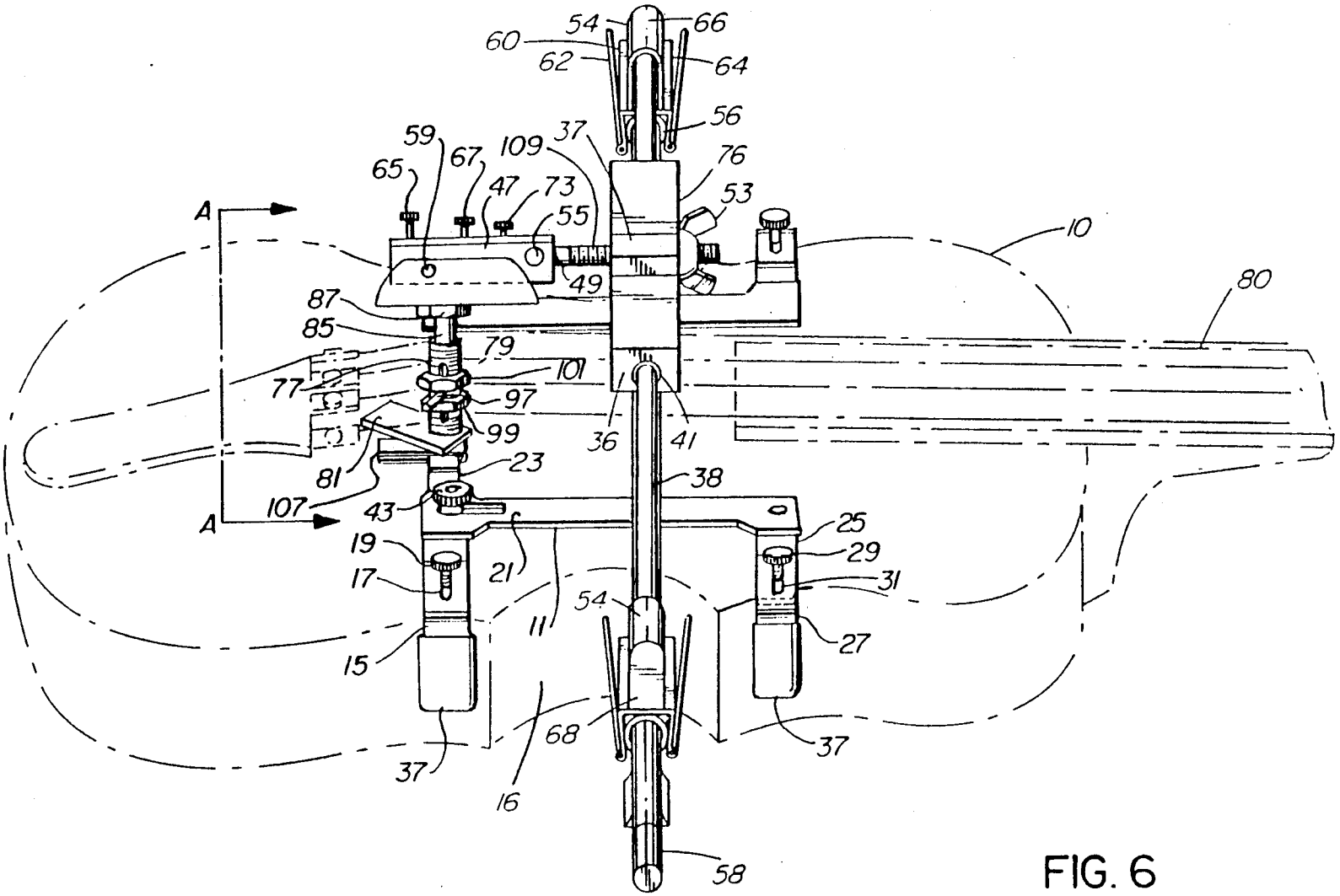
FIG. 6 is another perspective view of the embodiment shown in FIG. 5, viewed from the side of the violin.
Figure 7:
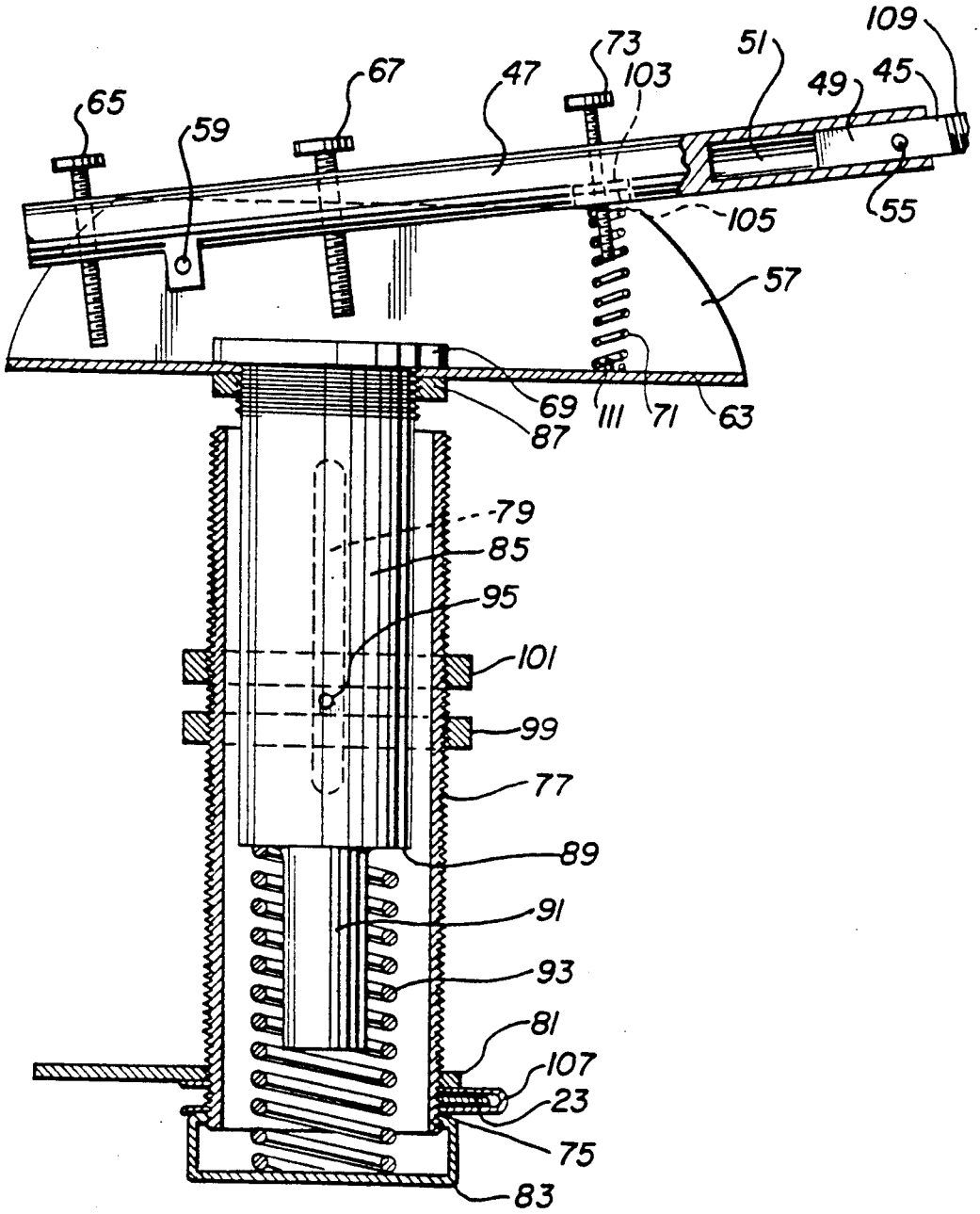
FIG. 7 is a cross-sectional view along the line A—A in FIG. 6.

A second embodiment of the bow guide is illustrated in FIGS. 5, 6 and 7. This is the embodiment that is preferred by the inventors and is believed to be the best mode of carrying out the invention. There is provided a stand 11 formed of a number of components to provide adjustability of size, permitting a proper fit on different sized violins. It comprises bridge member 13 to which corner members 15 are adjustably affixed. Slots 17 are provided in members 15. Thumbscrews 19 pass through slots 17 and when tightened hold members 15 snugly around the edges of the violin just posterior to C-slots 16. A pin (not shown in the drawings) extends through slot 17 from the upper surface of member 13 to prevent member 15 from turning relative to bridge member 13, when the bow guide is in use. Bridge member 13 has a centre section 23 which extends upward over the strings slightly behind the bridge 24 of the violin. A pair of members 21 are affixed at their posterior ends to bridge member 13, one on either side of centre section 23. Members 21 extend forwardly adjacent fingerboard 80. They are cut away in their middle sections to minimize interference with the hair of the bow, when bowing on the outer strings. Members 25 extend outwardly at right angles from the anterior end of members 21, to which they are rigidly affixed. Corner members 27 are adjustably affixed to members 25 by thrumbscrew 29, which pass through slots 31 in corner members 27. Corner members 27 grip the violin anterior to the C-slots. Corner members 15 and 27 preferably have protective rubber covers 37 to protect the violin. Slots 39 in members 21 permit adjustable positioning of members 21, and therefore of corner members 27. Thumbscrews 43, which extend through slots 39 are tightened to affix members 21 in the desired position.

Notches are provided on the inner side of the downwardly-projecting part of corner members 27 and 15 to facilitate positioning of the stand at selected heights on the violin. The notches (through covers 37) engage the lip at the edge of the upper surface of the violin.

In the second embodiment of the invention, the rod guide 36, rod 38 and the means for attaching the rod 38 to bow 58 are the same as described above with respect to the first embodiment. Rod guide 36 is supported on threaded bolt 45 which is threaded through bore 42 and extends therefrom. Wing nut 53 is threaded on the end of bolt 45 which extends through rod guide 36, and can be tightened against rod guide 36 if desired to keep rod guide 36 from rotating about threaded bolt 44. When wing nut 53 is not tightened, rod guide 36 can pivot freely about bolt 45.

Bolt 45 has a threaded section 109, which extends through rod guide 36, and an unthreaded section 49 which is slidably received in bore 51 in arm 47, as shown in FIG. 7. The unthreaded section 49 of bolt 45 has a flat side; thumbscrew 55 in arm 47 is tightened against the flat side of section 49 to hold bolt 45 in a selected position in arm 47. A nylon locking insert is provided on thumbscrew 55 to keep the thumbscrew firmly locked against bolt 45. The position of bolt 45 is selected to place bow 58 in the desired position between bridge 24 and fingerboard 80. A ridge can be provided at the posterior end of bolt 45 to engage thumbscrew 55 and prevent bolt 45 from slipping out of bore 51 if thumbscrew 55 is not locked in place.

Channel member 57 is comprised of sidewalls 61 and bottom wall 63. Arm 47 is pivotally affixed in channel member 57 by pin 59 which extends through sidewalls 61 and pivotally attaches arm 47 thereto.

Thrumbscrew 65 is threaded through a bore through arm 47 posterior to pin 59. When turned downwards, its lower end abuts wall 63. The desired maximum upward extent of pivoting of arm 47 is controlled by the distance that thumbscrew 65 is extended through arm 47 towards wall 63.

Thumbscrew 67 is threaded through a bore through arm 47 anterior to pin 59. When turned downward, its lower end abuts head 69 of pin 85 on its upper surface. The desired maximum downward extent of pivoting of arm 47 is thus controlled by the distance that thumbscrew 67 is extended through arm 47 towards head 69. Further, arm 47 can be locked at a desired angle using thumbscrews 65, 67.

Recess 103 is provided in the lower surface of arm 47 anterior to thumbscrew 67. A bore is provided in arm 47 extending from its upper surface to recess 103. Thumbscrew 73 extends through said bore towards the upper surface of wall 63. Washer 105 is threaded on thumbscrew 71 and fixed in position in recess 103. Coil spring 71 extends between washer 103 and the upper side of wall 63 and is held in place by thumbscrew 73 and by projection 111 on the upper surface of bottom wall 63. Spring 71 biases arm 47 upwards, thus suspending rod guide 36 and bow 58 above the strings of the violin so that some downward pressure on the bow by the player is required to engage the strings. The tension of spring 71 can be increased by tightening thumbscrew 73, moving washer 103 downwards and compressing spring 71.

Channel member 57 is supported above centre section 23 of bridge member 13 by the following structure, as shown in FIG. 7. Mounting clip 107, which has a threaded bore 75 therethrough, is mounted on centre section 23 of the stand. It can be locked into a selected position thereon, as described below. Threaded sleeve 77 is a hollow, tubular member having a threaded outside wall and smooth inside wall. Two opposed longitudinal slots 79 are located on opposite sides of sleeve 77. Sleeve 77 is threaded into bore 75 of mounting clip 107, which is placed in a selected position on centre section 23, i.e. above a selected string or between selected strings. Lock arm 81 is threaded on sleeve 77 immediately above mounting clip 107 and is tightened down onto mounting clip 107 to affix it firmly in place and lock sleeve 77 into place on it. End cap 83 is threaded onto the bottom end of sleeve 77.

Channel member 57 is rigidly affixed to pin 85 through a bore in wall 63 by means of lock nut 87. Pin 85 has a head 69 which is square in cross-section and fits snugly between sidewalls 61 of channel member 57, thus preventing pin 85 from rotating relative thereto. Pin 85 is a generally cylindrical, smoothwalled member having an outer diameter slightly smaller than the inside diameter of sleeve 77, to permit sliding movement of pin 85 within sleeve 77. Pin 85 has shoulder 89 and a narrow section 91 below the shoulder. Coil spring 93 is supported about section 91 and extends between shoulder 89 and end cap 83. Coil spring 93 thus biases pin 85 upwards.

The position of pin 85 within sleeve 77 is controlled by the following means. Bore 95 extends transversely through pin 85. Bar 97 is positioned therein, extending outwardly from bore 95 on one or both sides thereof through slots 79. The extent of vertical movement of pin 85 in sleeve 77 is then limited by the engagement of bar 97 with the upper and lower ends of slots 79. Nuts 99 and 101 are threaded about sleeve 77 and are abutted by bar 97 as pin 85 moves up and down respectively. They are positioned closely together, on either side of bar 97, to lock pin 85 in a selected position. Rotation of pin 85 in sleeve 77 is prevented by the engagement of bar 97 against the sides of slots 79. In an alternative configuration the sleeve has a bore which is non-circular in cross-section, e.g. square or hexagonal, and the cross-sectional shape of the pin corresponds thereto. Rotation of the pin in the sleeve is then prevented by the engagement of the walls of the pin against the walls of the bore.

With the second embodiment described above, the means for attaching rod 38 to bow 58 can be the same as for the first embodiment, using sleeves 54. However, it is possible to use "closed" sleeves, i.e. without a hood-like structure. Such sleeves have a bore which snugly receives the ends of rod 38, preventing up and down movement of the ends of the rod within the sleeves. Such sleeves hold the rod at a fixed distance from the back of the bow. This configuration is possible by virtue of the pivoting movement of arm 47 and bolt 45 which permits up and down movement of the bow guide 36: such movement permits the hair of the violin to contact each string of the violin properly notwithstanding that the bow cannot move up and down relative to the rod 38.

To use the second embodiment of the bow guide, it is installed firmly on the violin in the position shown in FIGS. 5 and 6, with rod 38 in a plane substantially at right angles to the strings. Sleeve 85 is tightened in the desired position on bridge section 23 of the stand by lock arm 81. Pin 85 is set at the desired height by adjusting nuts 99 and 101 to the proper height and tightening them about bar 97. Thumbscrews 65 and 67 are set to permit arm 47 to pivot to the extent desired, if any, and at the height desired to play exercises on particular strings or groups of strings, or on all four strings. The amount of pivoting of arm 47 that is set determines the degree of freedom of the student to lift the bow off the strings. Thumbscrew 73 is tightened or loosened to adjust the tension in spring 71 as desired. The position of the bow between the bridge and fingerboard of the violin is set at a chosen position by adjusting the position of bolt 45 in bore 51 of arm 47 and/or by turning rod guide 36 on bolt 45.

The bow guide has been described and illustrated in a form suitable for use on a violin. However, it is apparent that it can readily be adapted, primarily by varying the size of the stand, for use on the viola, cello, double bass and similar instruments.

We claim:

1. A bow guide for a stringed, bow-played instrument, such as a violin, said instrument having a plurality of strings, a bridge and a fingerboard, said instrument being playable by a bow which has a back and two ends, said bow guide comprising:

(a) slide means comprising a rod for affixing to the bow;

(b) means for attaching the rod to the bow whereby the rod extends substantially between the ends of the bow;

(c) guide means comprising a rod guide having means for slidably receiving the rod and for guiding the rod for movement at substantially right angles to the strings; and (d) means for supporting the rod guide above the strings of the instrument and between the bridge and fingerboard thereof.

2. A bow guide according to claim 1 wherein the rod guide support means includes a stand which is adjustable to fit a range of sizes of instruments.

3. A bow guide for a stringed, bow-played instrument, such as a violin, said instrument having a plurality of strings, a bridge and a fingerboard, said instrument being playable by a bow which has a back and two ends, said bow guide comprising:

(a) slide means comprising a rod having two ends for affixing to the bow;

(b) means for attaching the rod to the bow whereby the rod extends substantially between the ends of the bow;

(c) guide means comprising a rod guide having means for slidably receiving the rod and for guiding the rod at substantially right angles to the strings;

(d) means for supporting the rod guide above the strings of the instrument and between the bridge and fingerboard thereof, the rod guide support means having axis means above which the rod guide is pivotally attached, the axis means being perpendicular to the means for slidably receiving the rod, whereby the bow slidably engages the stings.

4. A bow guide according to claim 3 wherein the means for slidably receiving the rod is a bore through the rod guide.

5. A bow guide according to claim 4 further including means for increasing the resistance to movement of the rod through the bore.

6. A bow guide according to claim 5 wherein the resistance increasing means comprises a ball and means for urging the ball against the rod.

7. A rod guide according to claim 3 wherein the axis means can be affixed at selected distances above the strings, said rod guide including means for varying the distance of the axis means above the strings.

8. A bow guide according to claim 3 wherein the means for attaching the rod to the bow includes a sleeve affixed proximate each of said ends of the bow, each of said sleeves having an opening extending from proximate the bow to a position spaced therefrom, said opening being sufficiently large to receive an end of said rod and to permit the free movement of said end of said rod within said sleeve between a position proximate the bow and a second position spaced therefrom.

9. A bow guide according to claim 3 further including means for locking the rod guide in a selected position above the axis.

10. A bow guide to claim 3 wherein the rod guide support means includes:

(a) means for pivotally holding the axis means between a first position in which the rod guide is relatively close to the strings and a second position in which the rod guide is relatively farther away from the strings;

(b) a stand for affixing the rod guide to the instrument, the stand having a center portion extending over the strings of the instrument proximate the bridge thereof, and (c) supporting means affixed to the center portion of the stand for supporting the axis means holding means.

11. A bow guide according to claim 10 wherein the supporting means comprises a member affixed to the axis means holding means, the member having a bore transversely therethrough, a sleeve for slidably receiving the member having a pair of elongate slots therethrough, means for biasing the member away from the stand, a bar extending through the bore in the member and the elongate slots, and stop means for engaging the bar.

12. A bow guide according to claim 10 wherein the axis means comprises a first section having a bore therein and a second section which is slidably received in the bore.

13. A bow guide according to claim 10 further comprising means for limiting the extent of pivotal movement of the axis means.

14. A bow guide according to claim 3 wherein the rod guide support means includes a stand which is adjustable to fit a range of sizes of instruments.

* * * * *